US007168188B2

(12) United States Patent
Auger et al.

(10) Patent No.: US 7,168,188 B2
(45) Date of Patent: Jan. 30, 2007

(54) ARTICLE FOOTWEAR WITH REMOVABLE HEEL PAD

(75) Inventors: Perry W. Auger, Tigard, OR (US); Neil Crumbleholme, Portland, OR (US); Brian D. Baker, Portland, OR (US); Peter A. Hudson, Portland, OR (US)

(73) Assignee: Nike, Inc., Beaverton, OR (US)

( * ) Notice: Subject to any disclaimer, the term of this patent is extended or adjusted under 35 U.S.C. 154(b) by 299 days.

(21) Appl. No.: 10/891,837

(22) Filed: Jul. 15, 2004

(65) Prior Publication Data

US 2006/0010718 A1 Jan. 19, 2006

(51) Int. Cl.
*A43B 3/26* (2006.01)

(52) U.S. Cl. ..... 36/69; 36/58.5; 36/92

(58) Field of Classification Search ..... 36/58.5, 36/58.6, 69, 71, 80, 92, 93
See application file for complete search history.

(56) References Cited

U.S. PATENT DOCUMENTS

| | | | | | |
|---|---|---|---|---|---|
| 1,020,160 | A | * | 3/1912 | Lesch | 36/58.5 |
| 1,174,619 | A | * | 3/1916 | Schwartz et al. | 36/58.5 |
| 1,820,623 | A | * | 8/1931 | Lyons | 36/58.5 |
| 1,926,818 | A | * | 9/1933 | Rateliff | 36/58.5 |
| 1,966,179 | A | * | 7/1934 | Lesch | 36/58.5 |
| 2,275,191 | A | * | 3/1942 | Schwartz et al. | 36/58.5 |
| 2,438,280 | A | | 3/1948 | Gailey | 36/55 |
| 2,562,514 | A | | 7/1951 | Sibulkin et al. | 36/8.5 |
| 2,700,229 | A | * | 1/1955 | Dubin | 36/58.5 |
| 3,373,513 | A | * | 3/1968 | Jewell | 36/80 |
| 3,419,974 | A | * | 1/1969 | Lange | 36/117.6 |
| 4,179,826 | A | | 12/1979 | Davidson | 36/69 |
| 4,282,657 | A | | 8/1981 | Antonious | 36/50 |
| 4,325,380 | A | | 4/1982 | Malkin et al. | |
| 4,385,456 | A | * | 5/1983 | Livernois et al. | 36/115 |
| 4,402,146 | A | | 9/1983 | Parracho et al. | 36/129 |
| 4,441,264 | A | | 4/1984 | Hantz-Guibas et al. | 36/72 B |
| 4,541,186 | A | | 9/1985 | Mulvihill | 36/114 |
| 4,726,126 | A | * | 2/1988 | Bernhard | 36/89 |
| 4,783,909 | A | | 11/1988 | Van Doren et al. | 36/68 |
| 4,844,094 | A | | 7/1989 | Grim | 128/80 H |
| 4,941,273 | A | | 7/1990 | Gross | 36/114 |
| 5,408,761 | A | | 4/1995 | Gazzano | 36/88 |
| 5,465,509 | A | | 11/1995 | Fuerst et al. | 36/88 |
| 5,544,432 | A | | 8/1996 | Kita | 36/43 |
| 5,604,998 | A | | 2/1997 | Kita | 36/69 |
| 5,645,525 | A | | 7/1997 | Krivosha | 602/62 |
| 5,740,618 | A | * | 4/1998 | Minden | 36/8.3 |
| 5,799,416 | A | * | 9/1998 | Prober | 36/58 |
| 5,799,417 | A | * | 9/1998 | Burke et al. | 36/105 |
| 5,842,294 | A | | 12/1998 | Fabricant | 36/127 |
| 5,918,384 | A | | 7/1999 | Meschan | 36/37 |
| 6,023,857 | A | | 2/2000 | Vizy et al. | 36/30 R |

(Continued)

FOREIGN PATENT DOCUMENTS

| | | |
|---|---|---|
| EP | 0 643 931 A | 3/1995 |

(Continued)

*Primary Examiner*—Marie Patterson
(74) *Attorney, Agent, or Firm*—Banner & Witcoff, Ltd.

(57) ABSTRACT

An article of footwear includes a sole assembly, an upper secured to the sole assembly, a heel counter secured to the upper, and a heel pad removably attached to an inner surface of the heel counter.

27 Claims, 3 Drawing Sheets

U.S. PATENT DOCUMENTS

| | | | | |
|---|---|---|---|---|
| 6,079,128 | A * | 6/2000 | Hoshizaki et al. | 36/89 |
| 6,083,184 | A | 7/2000 | Kenosh | 602/27 |
| 6,112,434 | A | 9/2000 | Seltzer et al. | 36/115 |
| 6,125,557 | A | 10/2000 | Brown | 36/144 |
| 6,298,582 | B1 | 10/2001 | Friton et al. | 36/88 |
| 6,402,163 | B1 | 6/2002 | Pratt | 280/11.26 |
| 6,442,874 | B1 * | 9/2002 | Long | 36/97 |
| 6,584,707 | B1 * | 7/2003 | Racine et al. | 36/97 |
| 6,594,922 | B1 | 7/2003 | Mansfield et al. | 36/145 |
| 6,684,532 | B1 | 2/2004 | Greene et al. | 36/28 |
| 6,701,643 | B1 | 3/2004 | Geer et al. | 36/97 |
| 7,028,417 | B1 * | 4/2006 | Tingle | 36/9 R |

FOREIGN PATENT DOCUMENTS

| | | | |
|---|---|---|---|
| FR | 724 188 | A | 4/1932 |
| GB | 2 000 958 | A | 1/1979 |
| WO | WO 02/05672 | A | 1/2002 |

* cited by examiner

ARTICLE FOOTWEAR WITH REMOVABLE HEEL PAD

FIELD OF THE INVENTION

This invention relates generally to an article of footwear, and, in particular, to an article of footwear with a removable heel pad.

BACKGROUND OF THE INVENTION

Conventional articles of athletic footwear include two primary elements, an upper and a sole structure. The upper is often formed of leather, synthetic materials, or a combination thereof and comfortably secures the footwear to the foot, while providing ventilation and protection from the elements. The sole structure generally incorporates multiple layers that are conventionally referred to as an insole, a midsole, and an outsole. The insole is a thin cushioning member located within the upper and adjacent the sole of the foot to enhance footwear comfort. The midsole, which is traditionally attached to the upper along the entire length of the upper, forms the middle layer of the sole structure and serves a variety of purposes that include controlling potentially harmful foot motions, such as over pronation, attenuating ground reaction forces, and absorbing energy. In order to achieve these purposes, the midsole may have a variety of configurations, as discussed in greater detail below. The outsole forms the ground-contacting element of footwear and is usually fashioned from a durable, wear resistant material that includes texturing to improve traction.

A heel counter is often provided at the rear of the footwear, and is contoured to wrap around the user's heel and along the sides of the footwear. The heel counter provides stability and support for the user's heel. The upper wraps around the rear exterior surface of the heel counter and is secured thereto, with a seam typically being provided in the upper at the rear of the heel counter.

It is an object of the present invention to provide an article of footwear with a heel pad that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear with a removable heel pad that provides additional cushioning and support for a user's heel and ankle.

In accordance with a preferred embodiment, an article of footwear includes a sole assembly, an upper secured to the sole assembly, a heel counter secured to the upper, and a heel pad removably attached to an inner surface of the heel counter.

In accordance with another preferred embodiment, an article of footwear includes a sole assembly and an upper secured to the sole assembly. A heel counter is secured to the upper and has a plurality of recesses. A heel pad having a plurality of projections extends outwardly from an exterior surface thereof, with each projection being received by a corresponding recess to removably attach the heel pad to the heel counter.

In accordance with a further preferred embodiment, an article of footwear includes a sole assembly having an outsole, a midsole and an insole. An upper is secured to the midsole, and a heel counter is secured to the upper. The heel counter has a first recess on a medial side thereof and a second recess on a lateral side thereof. A heel pad has a first projection on a medial side thereof and a second projection on a lateral side thereof. The first recess receives the first projection and the second recess receives the second projection. A first fastener secures the first projection within the first recess, and a second fastener secures the second projection within the second recess. A collar is secured to an interior surface of the upper, with a lower surface of the collar being adjacent an upper edge of the heel pad.

In accordance with yet another preferred embodiment, an article of footwear includes a sole assembly having an outsole, a midsole and an insole. An upper is secured to the midsole, and a heel counter is secured to the upper. The heel counter has a first aperture on a medial side thereof and a second aperture on a lateral side thereof. A heel pad has a first projection on a medial side thereof and a second projection on a lateral side thereof. The first aperture receives the first projection and the second aperture receives the second projection. A collar is secured to an interior surface of the upper, with a lower surface of the collar being adjacent an upper edge of the heel pad.

Substantial advantage is achieved by providing an article of footwear with a removable heel pad. In particular, preferred embodiments of the present invention help improve the fit about a user's heel, helping to maintain the heel in proper position, reduce relative movement of the user's heel, and improve comfort. Additionally, preferred embodiments of the present invention allow different heel pads to be installed in the article of footwear, allowing customization and/or optimization of the footwear.

These and additional features and advantages of the invention disclosed here will be further understood from the following detailed disclosure of certain preferred embodiments.

Figure 1:
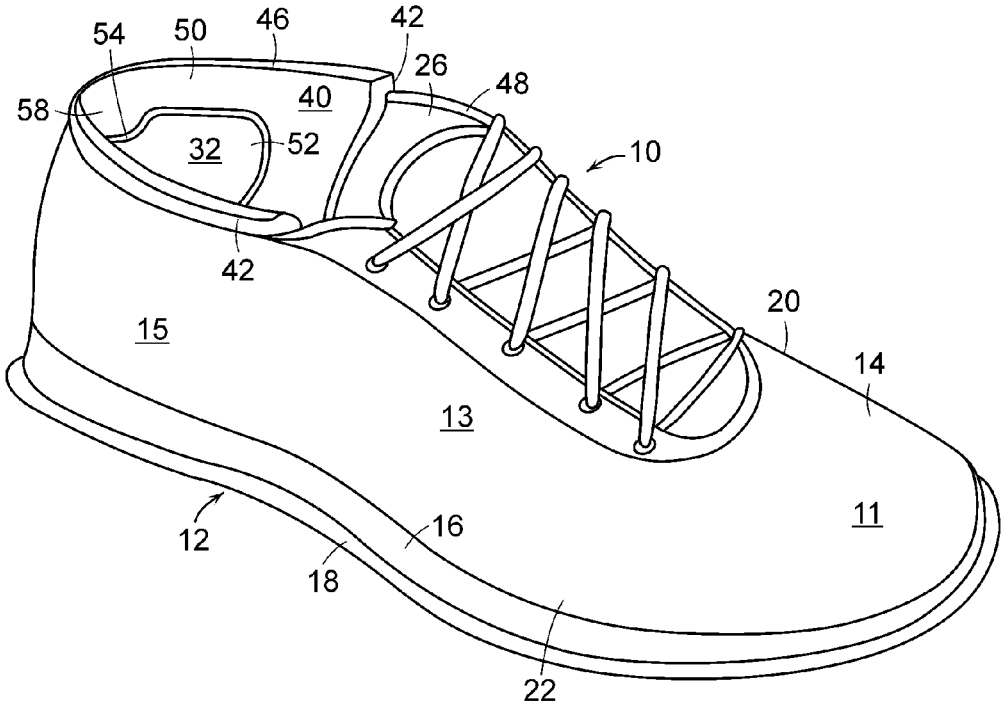
FIG. 1 is a perspective view of an article of footwear in accordance with a preferred embodiment of the present invention.

The figures referred to above are not drawn necessarily to scale and should be understood to provide a representation of the invention, illustrative of the principles involved. Some features of the article of footwear with a replaceable heel pad depicted in the drawings have been enlarged or distorted relative to others to facilitate explanation and understanding. The same reference numbers are used in the drawings for similar or identical components and features shown in various alternative embodiments. Articles of footwear with a replaceable heel pad as disclosed herein would have configurations and components determined, in part, by the intended application and environment in which they are used.

DETAILED DESCRIPTION OF CERTAIN PREFERRED EMBODIMENTS

The present invention may be embodied in various forms. The following discussion and accompanying figures disclose an article of footwear 10 in accordance with the present invention. Footwear 10 may be any style of footwear including, for example, athletic footwear. Although the embodiments illustrated herein depict athletic footwear, the present invention is not to be restricted to athletic footwear, and could in fact be incorporated in any style of footwear.

A preferred embodiment of an article of footwear 10 is shown in FIG. 1. Footwear 10 includes a sole assembly 12 and an upper 14 secured to sole assembly 12. Upper 14 may be secured to sole assembly 12 by any suitable means including, for example, stitching or an adhesive. Upper 14 forms an interior void that comfortably receives a foot and secures the position of the user's foot relative to sole assembly 12. As noted above, the configuration of upper 14 depicted here is suitable for use during athletic activities. Accordingly, upper 14 may have a lightweight, breathable construction that includes multiple layers of leather, textile, polymer, and foam elements adhesively bonded and stitched together. For example, upper 14 may have an exterior that includes leather elements and textile elements for resisting abrasion and providing breathability, respectively. The interior of upper 14 may have foam elements for enhancing the comfort of footwear 10, and the interior surface may include a moisture-wicking textile for removing excess moisture from the area immediately surrounding the foot.

For purposes of general reference, footwear 10 may be divided into three general portions: a forefoot portion 11, a midfoot portion 13, and a heel portion 15. Portions 11, 13, and 15 are not intended to demarcate precise areas of footwear 10. Rather, portions 11, 13, and 15 are intended to represent general areas of footwear 10 that provide a frame of reference during the following discussion.

Sole assembly 12 includes a midsole 16 to which upper 14 is secured, and an outsole 18, which may include a tread pattern (not shown) for added traction. An insole 19 (also referred to as a sock liner), seen in FIG. 3, may be positioned within upper 14 above midsole 16. Footwear 10 has a medial, or inner, side 20 and a lateral, or outer, side 22. Although sides 20, 22 apply generally to footwear 10, references to sides 20, 22 may also apply specifically to upper 14, sole assembly 12, or any other individual component of footwear 10.

Unless otherwise stated, or otherwise clear from the context below, directional terms used herein, such as rear, rearwardly, front, forwardly, inwardly, outwardly, lower, downwardly, upper, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 15, that is, to the left as seen in FIG. 1. Naturally, forwardly is toward forefoot portion 11, that is, to the right as seen in FIG. 1, downwardly and lower are toward the bottom of the page as seen in FIG. 1, and upwardly is toward the top of the page as seen in FIG. 1. Inwardly is toward the center of footwear 10, and outwardly is toward the outer periphery of footwear 10.

Figure 2:
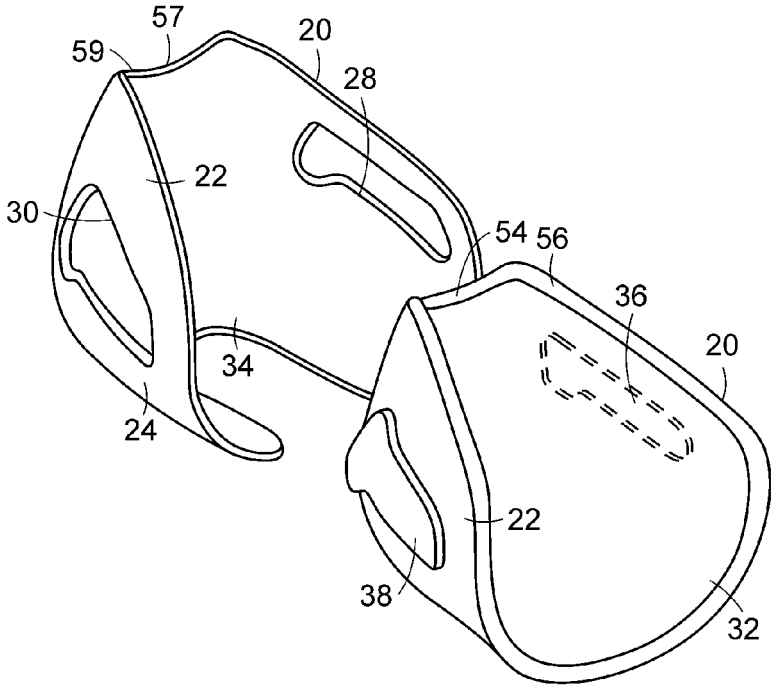
FIG. 2 is perspective view, in exploded form, of a heel counter and heel pad of the article of footwear of FIG. 1.
Figure 3:
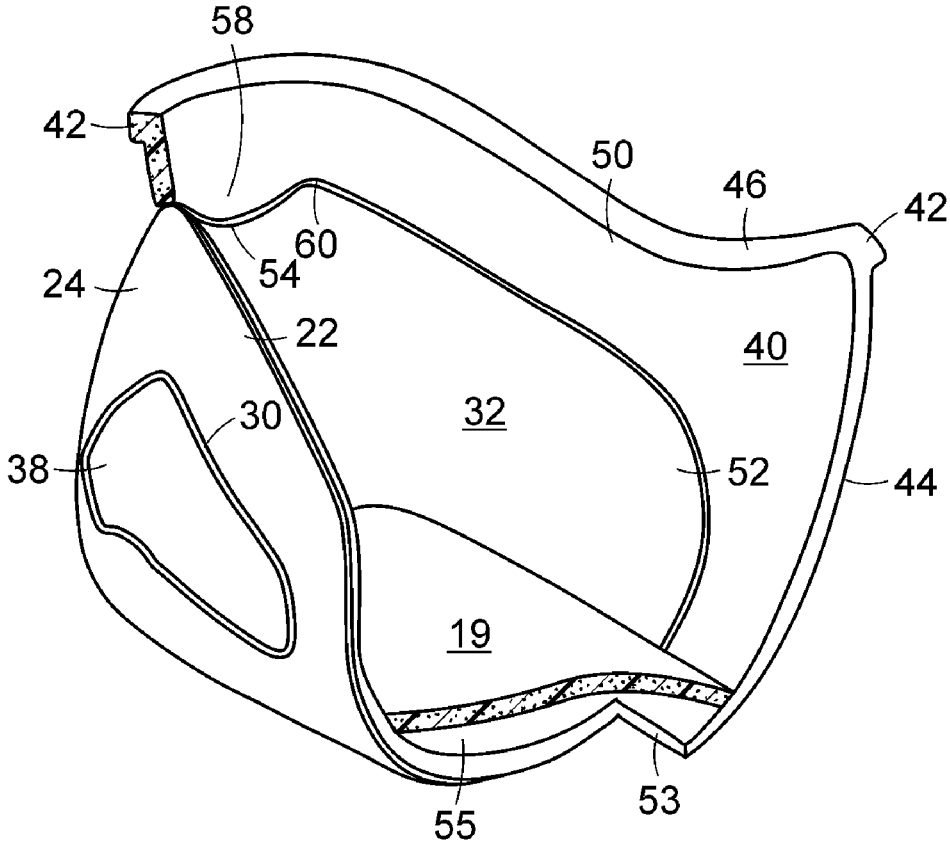
FIG. 3 is a perspective view of the heel counter, heel pad and collar (shown partially broken away) of FIG. 1, shown in assembled form.

A heel counter 24, seen in FIGS. 2–3, is secured to an interior surface 26 of heel portion 15 of upper 14. In certain preferred embodiments, heel counter 24 is adhesively secured to interior surface 26 by way of cement or any other suitable adhesive. Heel counter 24 includes a first aperture 28 formed in medial side 20 and a second aperture 30 formed in lateral side 22. Heel counter 24 is preferably formed of a substantially rigid material, such as thermoplastic polyurethane, nylon, or any semi-rigid or rigid formable material. Heel counter 24 acts to provide stability and support about the user's heel and ankle.

A heel pad 32 is removably positioned within footwear 10 and abutting an interior surface 34 of heel counter 24. In the illustrated embodiment, a first projection 36 is formed on medial side 20 of heel pad 32, and a second projection 38 is formed on lateral side 22 of heel pad 32. First and second projections 36 and 38 are received by first and second apertures 28, 30, respectively, such that heel pad 32 is removably attached to heel counter 24. Projections 36, 38 may be formed of unitary, that is, one-piece construction with heel pad 32, or they may be separate elements secured to heel pad 32 by adhesive or other suitable fastening means.

It is to be appreciated that the removable heel pad 32 need not necessarily have two projections, nor does heel counter 24 necessarily require two apertures into which the projections extend and in which they are received. A single projection and mating aperture or more than two projections and mating apertures may be formed in heel pad 32 and heel counter 24, respectively.

Further, it is to be appreciated that the size and shape of the projections and mating apertures may vary as well. In the illustrated embodiment, projections 36, 38 and apertures 28, 30 have a generally L-shape and inverted L-shape configurations. However, it is to be appreciated that these configurations are merely illustrative and any other shapes are considered to be within the scope of the present invention.

In certain preferred embodiments, a collar 40 is positioned adjacent interior surface 26 of heel portion 15 of upper 14 above heel counter 24 and heel pad 32, as seen in FIG. 3. Collar 40 may be adhesively secured to upper 14 by way of cement, epoxy or other suitable adhesive. It is to be appreciated that collar 40 may be secured to upper 14 by stitching or any other suitable means, which will become readily apparent to those skilled in the art, given the benefit of this disclosure.

In the illustrated embodiment, a rib 42 is formed on an exterior surface 44 of collar 40 proximate an upper edge 46 thereof. Rib 42 is positioned adjacent an upper edge 48 of heel portion 15 of upper 14. Collar 40 helps to capture heel pad 32 and maintain it in proper position within upper 14. In a preferred embodiment, an interior surface 50 of collar 40 is substantially flush with an interior surface 52 of heel pad 32. Front lower ends 53 of collar 40 wrap down along inner surface 26 of upper 14 and extend beneath insole 19 on the medial 20 and lateral sides 22 of footwear 10. Insole 19 is positioned above a lower surface 55 of heel pad 32.

In a preferred embodiment, a recess 54 is formed in a rear area of upper edge 56 of heel pad 32. A recess 57 is similarly formed in a rear upper edge 59 of heel counter 24. A mating tab 58 is formed on a rear lower edge 60 of collar 40. Tab 58 is configured to mate or nest in recess 54 so as to help register heel pad 32 within upper 14.

To remove heel pad 32, a user pulls insole 19 upwardly away from heel pad 32, and pulls heel pad 32 out from engagement with heel counter 24 and from beneath collar 40. Heel pad 32 is inserted in the reverse order. Thus, the user positions heel pad 32 within heel portion 15 of upper 14, pressing projections 36, 38 into the corresponding recesses 28, 30 and ensuring that upper edge 56 of heel pad 32 is positioned beneath collar 40. Insole 19 is then placed on top of heel pad 32.

Figure 4:
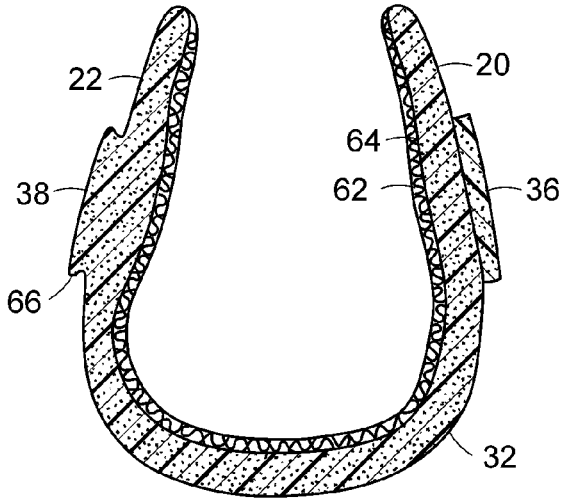
FIG. 4 is a section view of an alternative embodiment of the heel pad of FIG. 2.

Another preferred embodiment of heel pad 32 is shown in FIG. 4. As noted above, projections 36, 38 may be unitary with heel pad 32 or separate elements secured thereto. In the illustrated embodiment, projection 38 on lateral side 22 is of unitary construction with heel pad 32 and projection 36 on medial side 20 is a separate element secured to heel pad 32 by way of a cement or other adhesive, or a separate material co-molded with the remainder of heel pad 32. While it is likely that projections 36, 38 on a particular heel pad 32 will both be of unitary construction or both be separate elements, it is not necessary that they both have the same construction.

As illustrated here, a liner 62 is secured to an interior surface 64 of heel pad 32. Liner 62 may be secured to heel pad 32 by way of cement or other suitable adhesive. Additionally, heat and pressure may be applied to liner 62 and heel pad 32 to ensure a good bond therebetween. Liner 62 acts to provide a smooth comfortable surface for the foot of the user. Liner 62 may be formed of a soft fabric such as nylon, polyester, synthetic leather, or any soft fabric.

In a preferred embodiment, peripheral edges of the projections may be undercut. As illustrated in FIG. 4, a peripheral edge 66 of projection 38 on lateral side 22 is shown to be undercut so as to be received in aperture 30 in snap-fit fashion, thereby enhancing the attachment of heel pad 32 to heel counter 24.

Heel pad 32 advantageously can be customized to provide extra support and cushioning about the user's ankle and heel. The thickness of heel pad 32 can be varied to optimize its fit. Heel pad 32 could, for example, be custom fit to very closely follow the profile of a particular individual's foot. In other embodiments, a generalized fit can be made based on the shape of a standard or average foot structure. Thus, the shape of heel pad 32 may be customized to more accurately reflect the shape of a user's foot, particularly about the ankle of a user. For example, as seen in FIG. 4, heel pad 32 is thicker in positioned inwardly of first and second projections 36, 38 so as to provide extra cushioning about the user's ankle to reduce or eliminate the gaps typically formed between the user's ankle and the interior surface of footwear 10.

Further, since heel pad 32 is removably attached to heel counter 24, a user can swap heel pad 32 out and replace it with another heel pad. Thus, a user, or any other individual, could insert a heel pad 32 with a desired construction into footwear 10, and easily replace that pad with a pad of another construction if so desired. This construction allows footwear 10 to easily be customized for particular individuals, particular conditions, or for any other parameter.

Heel pad 32 is preferably formed of a soft, resilient material so as to provide a comfortable feel for the user's heel and ankle. Heel pad 32 may be formed of, for example, a thermoformed ethylene vinyl acetate (EVA) foam, or a poured polyurethane foam (which may include a foaming agent), any plastic that could be made into a foam, or any pressurized or inflatable bladders, which can be independent elements or incorporated into the foam component. Other suitable materials for heel pad 32 will become readily apparent to those skilled in the art, given the benefit of this disclosure.

Figure 5:
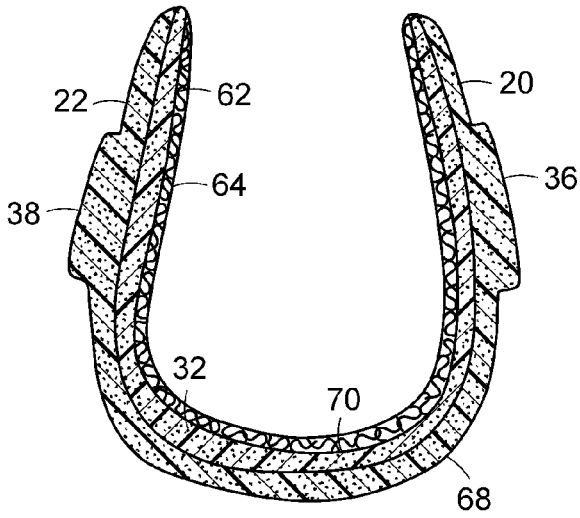
FIG. 5 is a section view of another alternative embodiment of the heel pad of FIG. 2.

As illustrated in FIG. 5, heel pad 32 may include a first portion 68 formed of a first material and a second portion 70 formed of a second material. In certain preferred embodiments, first portion 68 could be formed of a material having a first density of hardness, and second portion 70 could be formed of a material having a second density or hardness, thereby providing different levels of support for different areas of heel pad 32. For example, as illustrated in FIG. 5, first portion 68 is an outer layer and second portion 70 is an inner layer, with first portion 68 having a hardness greater than a hardness of second portion 70. It is to be appreciated that any combination of materials for first portion 68 and second portion 70 is possible. Additionally, it is to be appreciated that first portion 68 and second portion 70 need not be an inner and outer layer, respectively, but rather, could form any portion of heel pad 32.

Thus, it is to be appreciated that in certain preferred embodiments, heel pad 32 may be a multi-layer laminate of desired materials, such as different foams, and such a laminate is not limited to an inner layer and outer layer as described above in connection with FIG. 5. Heel pad 32 could be formed of a laminate of three or more layers of any desired materials.

Figure 6:
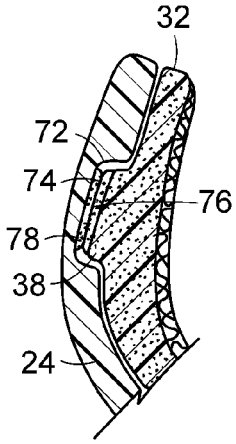
FIG. 6 is a section view of a portion of yet another alternative embodiment of the heel pad of FIG. 2.

Another preferred embodiment is shown in FIG. 6, in which projection 38 is received in a recess 72 formed in heel counter 24. Although only projection 38 and recess 72 are illustrated here, kit is to be appreciated that a recess could also be formed in medial side 20 of heel counter 24 to receive projection 36.

In certain preferred embodiments, a fastener 74 may be used to help secure projection 38 within recess 72. In the illustrated embodiment, fastener 74 is a hook and loop fastener with a first portion 76 secured to projection 38 and a second portion 78 secured to an interior surface of recess 72. It is to be appreciated that other types of fasteners will be suitable for securing projection 38 within recess 72 including, for example, snaps and snap rivets. Other suitable fasteners will become readily apparent to those skilled in the art, given the benefit of this disclosure.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

a sole assembly;

an upper secured to the sole assembly;

a heel counter secured to the upper and including at least one recess; and a heel pad removably attached to an inner surface of the heel counter and including at least one projection, each projection being received in a corresponding recess.

2. The article of footwear of claim 1, wherein a peripheral edge of each projection is undercut so as to engage a corresponding recess in snap-fit fashion.

3. The article of footwear of claim 1, further comprising at least one fastener, each fastener configured to secure a projection within a corresponding recess.

4. The article of footwear of claim 3, wherein the fastener comprises a hook and loop fastener.

5. The article of footwear of claim 4, wherein a first portion of the hook and loop fastener is secured to the projection and a second portion of the hook and loop fastener is secured to the recess.

6. The article of footwear of claim 1, wherein each projection is of unitary construction with the heel pad.

7. The article of footwear of claim 1, wherein each recess is an aperture.

8. The article of footwear of claim 1, further comprising a collar secured to an interior surface of the heel counter, a lower edge of the collar positioned adjacent an upper edge of the heel pad.

9. The article of footwear of claim 8, wherein a rib is formed along an exterior surface of the collar proximate an upper edge of the collar, the rib extending along an upper edge of an upper of the sole assembly.

10. The article of footwear of claim 8, wherein the collar is formed of foam with a fabric lining.

11. The article of footwear of claim 1, wherein the heel counter includes a first recess on a medial side thereof and a second recess on a lateral side thereof, and the heel pad includes a first projection on a medial side thereof and a second projection on a lateral side thereof, the first recess receiving the first projection and the second recess receiving the second projection.

12. The article of footwear of claim 11, further comprising a first fastener securing the first projection within the first recess and a second fastener securing the second projection within the second recess.

13. The article of footwear of claim 1, wherein the heel counter is formed of plastic.

14. The article of footwear of claim 1, wherein the heel pad is formed of polyurethane.

15. The article of footwear of claim 1, wherein the heel pad is formed of EVA.

16. The article of footwear of claim 1, wherein the heel pad is formed of a plurality of layers laminated together.

17. The article of footwear of claim 1, further comprising a liner secured to an interior surface of the heel pad.

18. The article of footwear of claim 1, wherein one portion of the heel pad is formed of a first material and a second portion of the heel pad is formed of a second material.

19. The article of footwear of claim 18, wherein an outer portion of the heel pad has a hardness greater than a hardness of an inner portion of the heel pad.

20. The article of footwear of claim 1, wherein the heel pad has a varying thickness.

21. An article of footwear comprising, in combination:

a sole assembly;

an upper secured to the sole assembly;

a heel counter secured to the upper and having a plurality of recesses; and a heel pad having a plurality of projections extending outwardly from an exterior surface thereof, each projection received by a corresponding recess to removably attach the heel pad to the heel counter.

22. The article of footwear of claim 21, further comprising at least one fastener, each fastener configured to secure a projection within a corresponding recess.

23. The article of footwear of claim 22, wherein the fastener comprises a hook and loop fastener, a first portion of the hook and loop fastener secured to the projection and a second portion of the hook and loop fastener secured to the recess.

24. The article of footwear of claim 21, further comprising a collar secured to an interior surface of the heel counter, a lower edge of the collar positioned adjacent an upper edge of the heel pad.

25. An article of footwear comprising, in combination:

a sole assembly comprising an outsole, a midsole and an insole;

an upper secured to the midsole;

a heel counter secured to the upper and having a first recess on a medial side thereof and a second recess on a lateral side thereof;

a heel pad having a first projection on a medial side thereof and a second projection on a lateral side thereof, the first recess receiving the first projection and the second recess receiving the second projection;

a first fastener securing the first projection within the first recess;

a second fastener securing the second projection within the second recess; and a collar secured to an interior surface of the upper, a lower surface of the collar adjacent an upper edge of the heel pad.

26. The article of footwear of claim 25, wherein each fastener comprises a hook and loop fastener, a first portion of each hook and loop fastener secured to a projection and a second portion of each hook and loop fastener secured to a recess.

27. An article of footwear comprising, in combination:

a sole assembly comprising an outsole, a midsole and an insole;

an upper secured to the midsole;

a heel counter secured to the upper and having a first aperture on a medial side thereof and a second aperture on a lateral side thereof;

a heel pad having a first projection on a medial side thereof and a second projection on a lateral side thereof, the first aperture receiving the first projection and the second aperture receiving the second projection; and a collar secured to an interior surface of the upper, a lower surface of the collar adjacent an upper edge of the heel pad.

* * * * *